US008739650B2

(12) United States Patent
Masumoto

(10) Patent No.: US 8,739,650 B2
(45) Date of Patent: Jun. 3, 2014

(54) CONTROL LEVER DEVICE FOR WORK VEHICLE

(75) Inventor: Koji Masumoto, Sakai (JP)

(73) Assignee: Kubota Corporation, Osaka (JP)

( * ) Notice: Subject to any disclaimer, the term of this patent is extended or adjusted under 35 U.S.C. 154(b) by 575 days.

(21) Appl. No.: 13/038,917

(22) Filed: Mar. 2, 2011

(65) Prior Publication Data

US 2011/0303045 A1 Dec. 15, 2011

(30) Foreign Application Priority Data

Jun. 14, 2010 (JP) ..... 2010-135194

(51) Int. Cl.
*G05G 1/06* (2006.01)

(52) U.S. Cl.
USPC ..... 74/523; 74/566

(58) Field of Classification Search
USPC ..... 74/18–18.2, 491, 504, 519, 523, 608; 180/90.6
IPC ..... G05G 25/02,25/04, 1/06
See application file for complete search history.

(56) References Cited

U.S. PATENT DOCUMENTS 1,487,009 A * 3/1924 Blum et al. ..... 180/90.6
1,503,756 A * 8/1924 Hasselberger ..... 180/90.6
4,094,545 A * 6/1978 Kramer ..... 296/190.08
2005/0139034 A1 * 6/2005 Komine et al. ..... 74/566
2005/0172883 A1 8/2005 Arakawa et al.

FOREIGN PATENT DOCUMENTS

JP 257346 U 4/1990
JP 4306131 A 10/1992
JP 680037 A 3/1994
JP 7315069 A 12/1995
JP 986209 A 3/1997
JP 2001117659 A * 4/2001 ..... G05G 25/04
JP 2005186720 A 7/2005
JP 2006313396 A * 11/2006 ..... G05G 25/04

* cited by examiner

*Primary Examiner* — Thomas Diaz
(74) *Attorney, Agent, or Firm* — The Webb Law Firm

(57) ABSTRACT

A control lever device for a work vehicle. The control lever device comprises a plurality of control levers to be movable along paths arranged in parallel with each other, a vertical limit member including lever openings formed therein for the plurality of control levers and extending to allow the movement of the control levers, dust-proof members movable along the back surface of the vertical limit member following the movement of the control levers to close the lever openings, lateral limit members for limiting displacement of the dust-proof members in a lateral direction relative to the moving direction of the control levers, and a base defining a movable surface for the dust-proof members. The vertical limit member and the lateral limit members are formed as a single cover to cover the dust-proof members.

6 Claims, 6 Drawing Sheets

CONTROL LEVER DEVICE FOR WORK VEHICLE

BACKGROUND OF THE INVENTION

1. Field of the Invention

The present invention relates to a control lever device for a work vehicle comprising a control lever projecting from an opening, and a dust-proof member provided in a position to close the lever-extending opening to be movable along with the control lever.

2. Description of the Related Art

The control lever device as noted above is well known. For example, Japanese Unexamined Patent Application Publication No. 9-86209 discloses a control lever device comprising a shift lever acting as a control lever, a housing including a linear guide groove formed therein for receiving the shift lever, and a flexible slide cover mounted under the guide groove to be movable in unison with the shift lever. Further, a guide rail is mounted for slidably supporting the slide cover at a position in the proximity of the bottom surface of the housing around the guide groove.

A dust-proof arrangement disclosed in the above Japanese reference is applied to a shift lever device for shifting an automatic change-speed device of an automobile. On the top surface of the housing are printed letters such as "P" or "L" indicating shifting positions. The shift lever extends through the slide cover, and the slide cover, in turn, follows movement of the shift lever when operated to close the guide groove. This prevents entry of foreign matters into the guide groove from the outside.

On the other hand, such a control lever device cannot be applied, as it stands, to a work vehicle such as a tractor that includes numerous control levers mounted on a drivers section. In such a work vehicle, a plurality of control levers are adjacent to each other and movable along moving paths arranged in parallel with each other. Further, since each control lever is operated independently, applying the conventional dust-proof arrangement for a single shift lever to such a work vehicle results in a complicated construction and hampers smooth operations of the levers. In addition, numerous parts are required, which eventually increases the cost. In particular, the work vehicle including the tractor comprises a cabin for improving a working environment, and thus has to reliably prevent dust and dirt from entering the interior of the cabin through guide grooves for the control levers.

SUMMARY OF THE INVENTION

The object of the present invention is to provide a control lever device for a work vehicle in which an opening allowing movement of each control lever is securely closed in all the shifting positions of the control lever to achieve a good dust-proof effect.

In order to achieve the above object, the present invention provides a control lever device for a work vehicle, comprising:

a plurality of control levers to be movable along paths arranged in parallel with each other;

a vertical limit member including lever openings formed therein for the plurality of control levers and extending to allow the movement of the control levers;

dust-proof members movable along the back surface of the vertical limit member following the movement of the control levers to close the lever openings;

lateral limit members for limiting displacement of the dust-proof members in a lateral direction relative to the moving direction of the control levers; and a base defining a movable surface for the dust-proof members;

wherein the vertical limit member and the lateral limit members are formed as a single cover to cover the dust-proof members.

With the above arrangement, since the plurality of dust-proof members follow the movement of the control levers, the plurality of lever openings are closed with the plurality of the dust-proof members regardless of the shifting position of the control levers. Further, the vertical limit member formed in a guide member is configured to limit movement of the plurality of dust-proof members away from the base, while the lateral limit members are configured to limit movement of the adjacent dust-proof members away from each other, as a result of which increase in number of parts can be suppressed without providing any special limit member exclusively used for each of the plurality of dust-proof members.

Further, when the plurality of dust-proof members are juxtaposed to each other, displacement of the adjacent dust-proof members away from each other is limited by the lateral limit members. Thus, even when a force is applied, when one of the control levers is operated, to one of the dust-proof members in a direction perpendicular to the operating direction of the control lever, the dust-proof member is brought into contact with each other or into contact with one of the lateral limit members to easily maintain the positional relationships among the plurality of the dust-proof members.

According to a preferred embodiment of the present invention, each of the control levers is shaped to have a dimension greater in the moving direction than in the lateral direction, which reduces a lateral space occupied by the plurality of dust-proof members arranged in parallel.

According to a preferred embodiment of the present invention, the plurality of dust-proof members are made of a flexible material and include slits for receiving the control levers. This enhances the effect of tight contact between the slits and the control levers.

When implements that are actually mounted on the work vehicle are operated by using the control lever apparatus of the present invention, it is preferable to connect a grip bar (a bar covered with a grip) to a distal end of each control lever so that the grip is positioned near the operator's hand. Further, in order to enhance the operational efficiency of the control lever, it is also preferable to provide a lever guide having a guide groove for guiding movement of the grip bar. Such a separated arrangement of the control lever (control lever body and grip bar) allows an exclusive space for the plurality of control levers to be small in the area in which the control levers cross the base (floor panel or the like), and allows a gap defined between the adjacent control levers to be large in the grip area.

DETAILED DESCRIPTION OF THE PREFERRED EMBODIMENT

A control lever device mounted on a tractor, as an example of embodiments of the present invention, will be described hereinafter in reference to the accompanying drawings.

[Overall Construction]

Figure 1:
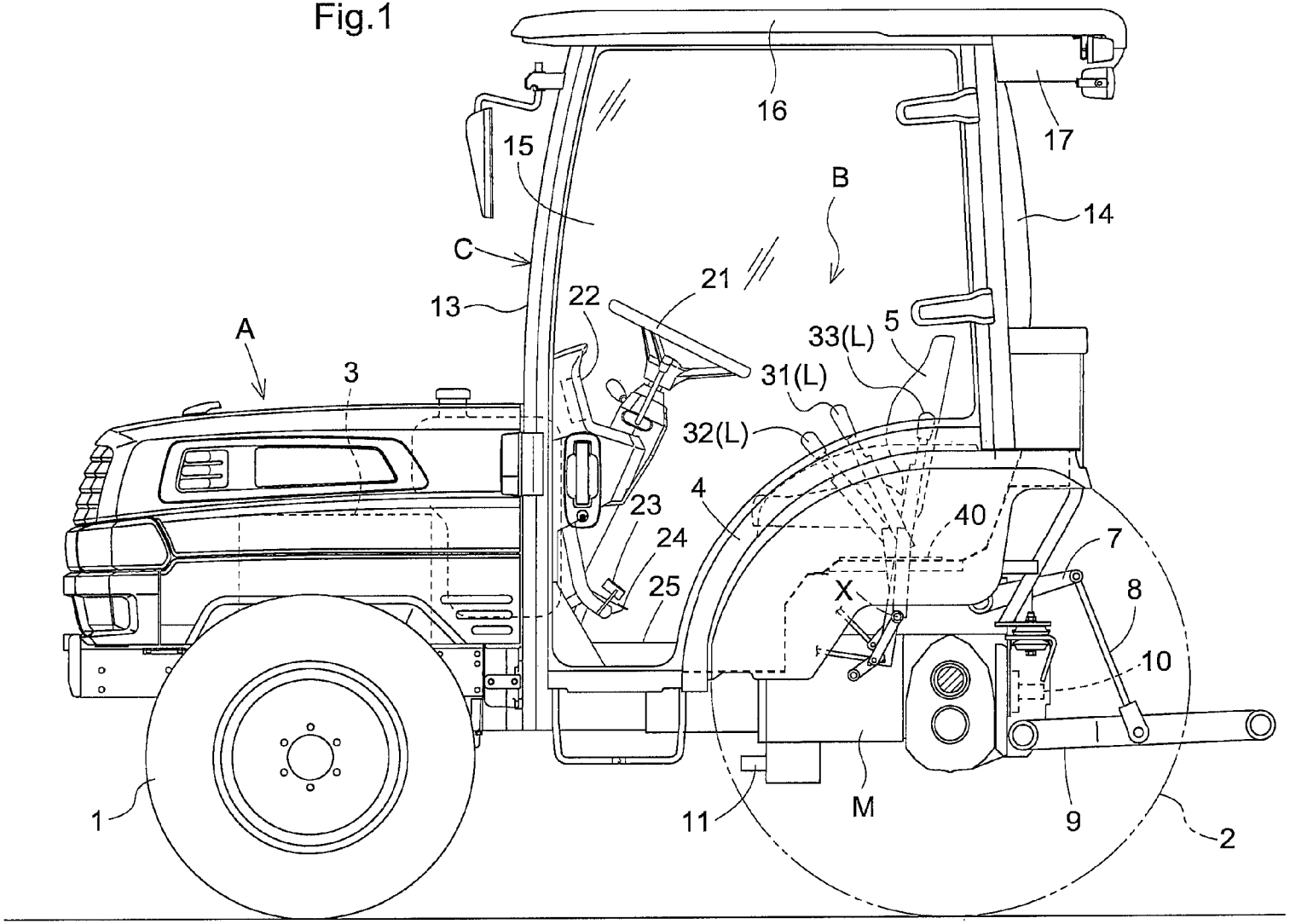
FIG. 1 is a side elevation of a tractor.

FIG. 1 shows the tractor acting as a work vehicle, comprising a pair of steerable right and left front wheels 1, a pair of right and left rear wheels 2, a power-supply section A including an engine 3 arranged forwardly of a vehicle body, a driver's section B including a driver's seat 5 mounted between a right and left rear-wheel fenders 4 rearwardly of the vehicle body, and a cabin C surrounding the driver's section B.

The tractor further comprises a transmission case M mounted under the driver's section B. At a rear end portion of the transmission case M are provided a pair of right and left lift arms 7 each having a projecting end vertically movable by operation of hydraulic cylinders (not shown), and a pair of right and left lower links 9 supported to the lift arms 7 in a suspended manner through lift rods 8. A rear PTO shaft 10 is mounted in a rear end of the transmission case M, and a mid PTO shaft 11 is mounted under the transmission case M.

With the above construction, a cultivating operation can be performed by connecting a rotary tiller (not shown) to a rear end of the vehicle body through the lower links 9 to be vertically movable, for example, and by forming a transmission line for transmitting drive power from the rear PTO shaft 10 to the rotary tiller thereby driving the rotary tiller. Alternatively, a plowing operation can be performed by connecting a plow (not shown) to the rear end of the vehicle body through the lower links 9 to be vertically movable, for example. Further, a ground-related working operation can be performed by providing a ground-working implement such as a lawn mower or grass-cutting device (not shown) in a mid portion of the vehicle body to drive the ground-working implement through driver power transmitted from the mid PTO shaft 11.

The cabin C includes a windshield 13 provided forwardly of the cabin, a rear shield 14 provided rearwardly of the cabin, glass doors 15 provided at the opposite sides of the vehicle body to be openable and closable, and a roof provided in the top of the vehicle, thereby preventing dust and dirt or noise from entering the driver's section from the outside. The cabin C also includes an air conditioner 17 for air-cooling or heating the driver's section B.

The driver's section B includes a steering wheel 21 provided forwardly of the driver's seat 5 for performing steering operations, an instrument panel 22 having meters and provided forwardly of the steering wheel 21, and a clutch pedal 23 and a brake pedal 24 distributed at opposite sides of and under the steering wheel 21. A platform 25 is provided at a lower portion of the driver's section B.

Figure 2:
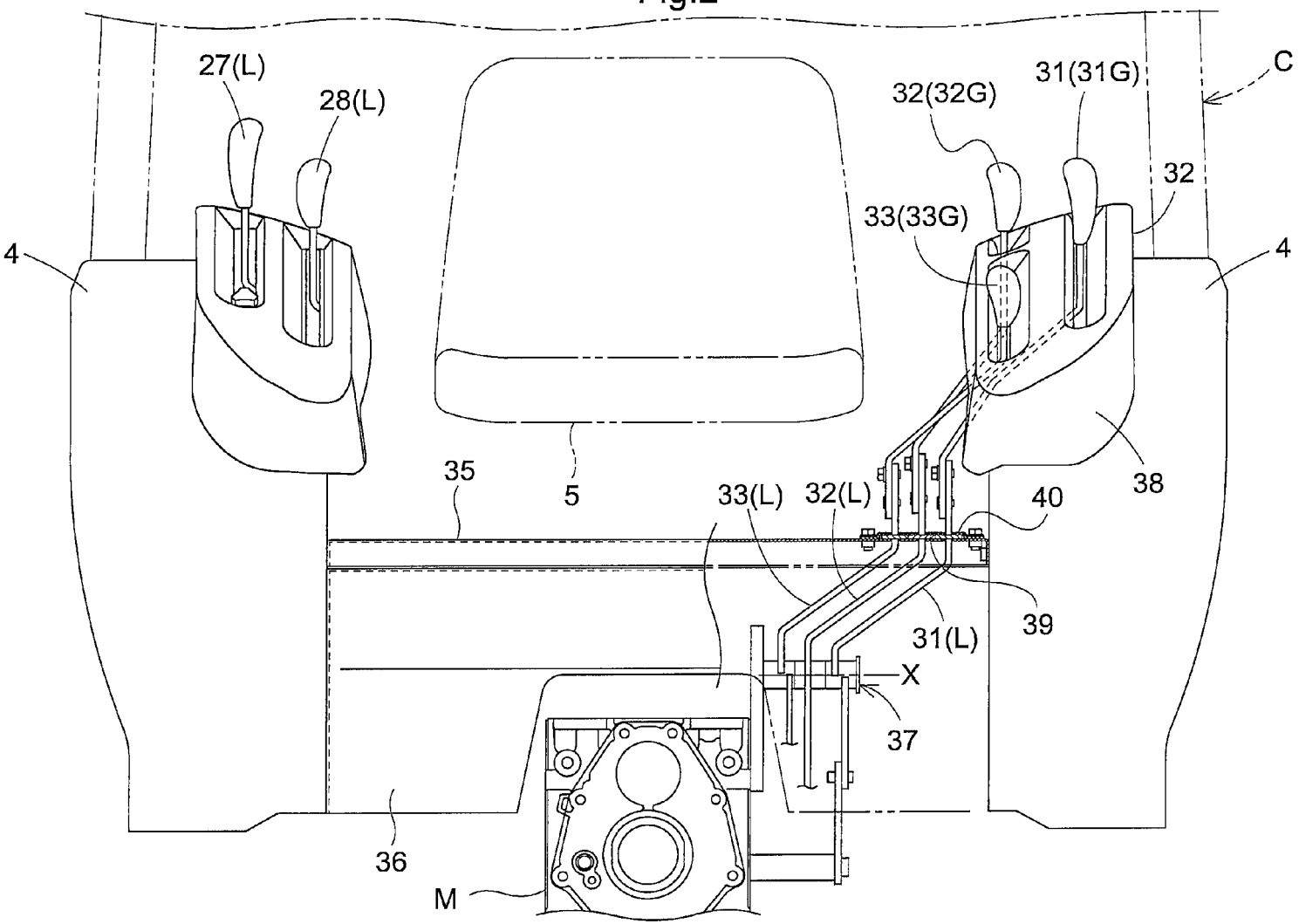
FIG. 2 is a front view of a driver's section illustrating a driver's seat and control levers.
Figure 3:
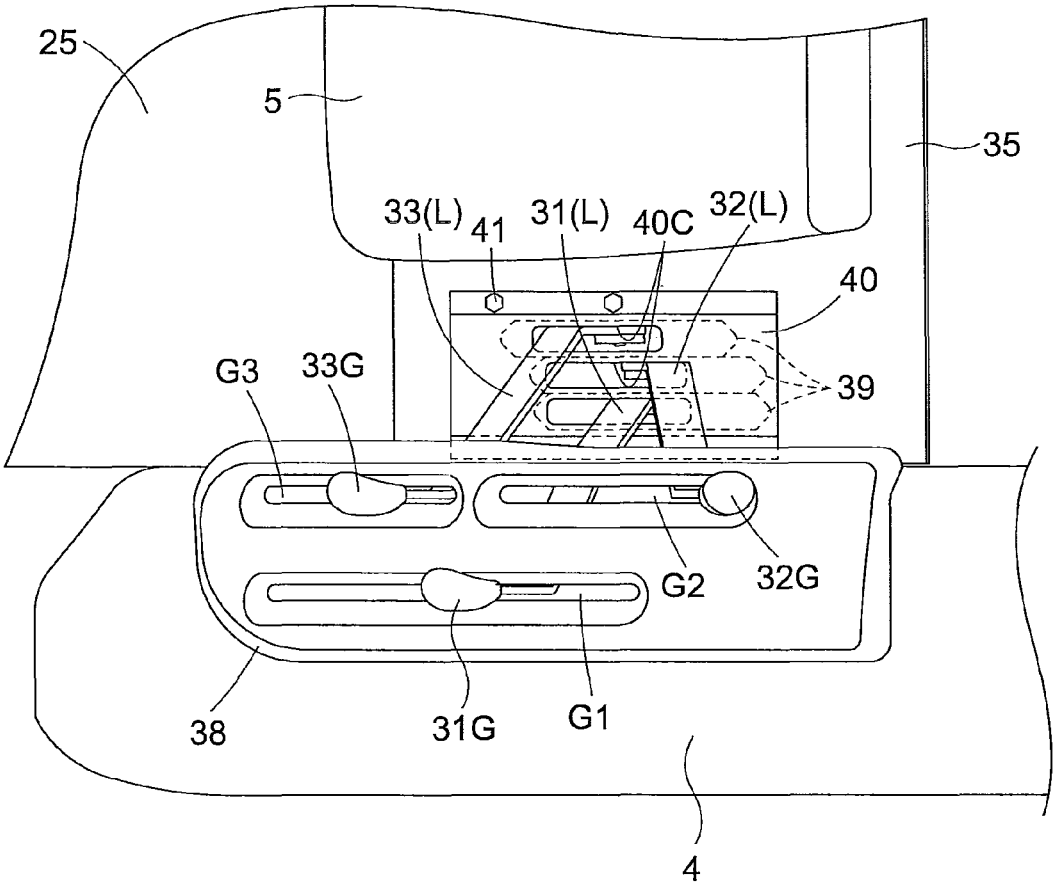
FIG. 3 is a top plan view of an arrangement of the control levers.

As shown in FIG. 2, at the right side of the driver's seat 5 are provided a main shift lever 27 for setting running speed of the vehicle body, and a plowing-depth setting lever 28 for setting a depth of plowing in the cultivating operation performed by the rotary tiller. At the left side of the driver's seat 5 are provided an auxiliary shift lever 31 for setting the running speed of the vehicle body, a PTO selection lever 32, and a PTO switch lever 33.

It should be noted that the main shift lever 27 and the auxiliary shift lever 31 are set to selected positions, respectively, to operate a change-speed mechanism mounted within the transmission case M to shift positions corresponding to the selected positions of the levers, as a result of which setting of the running speed is established. The PTO selection lever 32 is operable to select one or both of the rear PTO shaft 10 and the mid PTO shaft 11 as a driven shaft. The PTO switch lever 33 switches one of the PTO shafts 10 and 11 that has been selected as the driven shaft between a drive mode and a stop mode.

In the present invention, the main shift lever 27, plowing-depth setting lever 28, auxiliary shift lever 31, PTO selection lever 32 and PTO switch lever 33 are generally referred to as control levers L. In the following description for the dust-proof arrangement, the control levers L will be explained. In the current embodiment, each control lever L has a two-part structure including a grip bar having a distal end provided with a grip, and a control lever body bolted to the grip bar, but will be dealt with as a one-piece element without distinguishing the grip bar from the control lever body.

[Control Lever Device]

Figure 7:
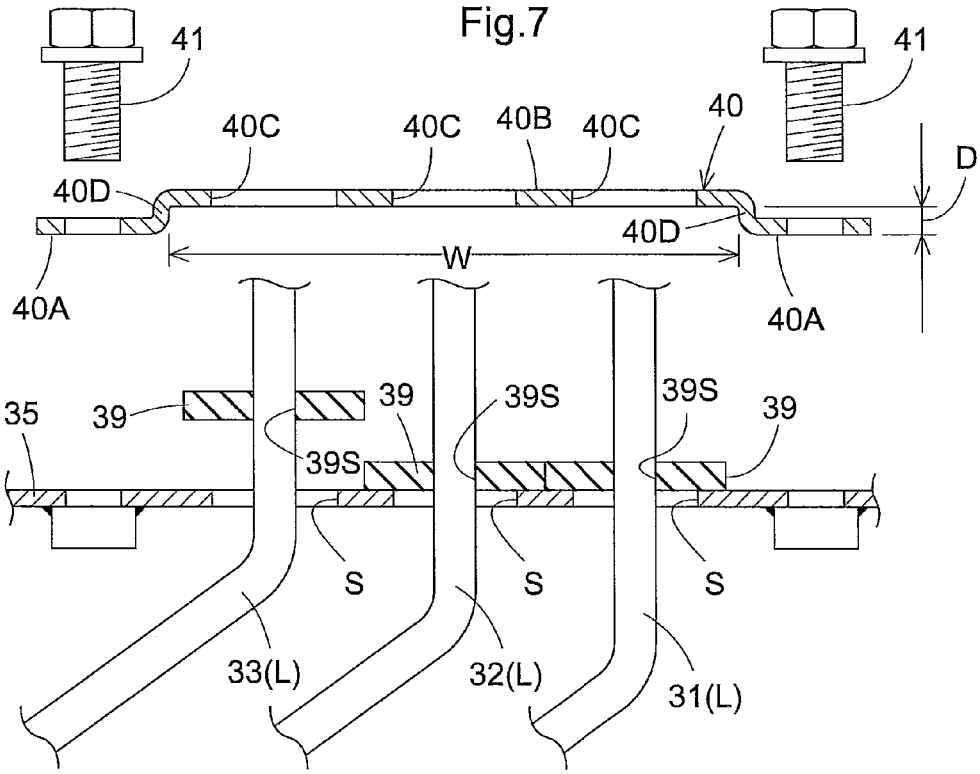
FIG. 7 is a sectional view illustrating a condition in which a wall member, dust-proof members and a guide member are disassembled.

Any of the control levers L arranged at the opposite sides of the driver's seat 5 is operable in a fore-and-aft direction, and is provided with the dust-proof arrangement in the present invention for eliminating a disadvantage that dust and dirt or noise enters the cabin through lever-extending through bores S (see FIG. 7) acting as lever openings for receiving a plurality of control levers.

The control lever device including the auxiliary lever 31, the PTO selection lever 32 and PTO switch lever 33 will be described in detail as a specific example of the control lever device. As shown in FIGS. 2 to 7, under the driver's seat 5 is provided a wall member 35 acting as a base in the form of a steel plate extending horizontally. The wall member 35 is connected to the rear fenders 4 at the opposite lateral ends thereof and to the platform 25 at a front portion thereof through a vertical wall 36.

The auxiliary lever 31, the PTO selection lever 32 and PTO switch lever 33 each includes a plurality of plate-like steel elements that are connected to each other to be bent to be pivotably supported at a proximal end thereof about an horizontal axis X of a support shaft 37 mounted in a side portion of the transmission case M. Each control lever L is operatively connected at a lower end thereof to a gear change-speed mechanism or clutch mechanism mounted within the transmission case through a link mechanism or a rod, for example. Each control lever L has a resin grip 31G, 32G or 33G at a top end thereof.

A lever guide 38 made of a resin mold is provided in the left rear fender 4. Groove-like guide bores G1, G2 and G3 are formed, through which the control levers L extend to be operable. At the sides of those guide bores G1, G2 and G3 are printed numerals or letters indicating shifting positions of the control levers.

The wall member 35 includes the three lever-extending through bores S for receiving the three control levers (auxiliary shift lever 31, PTO selection lever 32 and PTI switch lever 33) formed as slit-like lever openings elongated in the fore-and-aft direction. Dust-proof members 39 are provided to have dimensions enough to close the lever openings at any shifting position. The dust-proof members 39 each includes a slit 39S through which the control lever L extends. A cover 40 is connected and fixed to the wall member 35 through bolts 41 for covering all the three dust-proof members 39 over the moving loci of the control levers. As described below, the cover 40 functions as a guide member 40 for guiding movement of each control lever L (specifically, the control lever body in the lower part of the control lever L).

Each of the dust-proof members 39 is made of a flexible material such as rubber and has a width sufficiently greater than the width of each lever-extending through bore S and a length for closing the lever-extending through bore S even when the control lever L is operated. In particular, the width of each dust-proof member 39 is determined so that a small gap may be formed between the adjacent dust-proof members.

The guide member (cover) 40 has connecting portions 40A formed at opposite ends thereof, and a vertical limit member 40B for the dust-proof members 39 formed as a ceiling wall bulging upward from a middle portion of the guide member that is positioned between the connecting portions 40A. The vertical limit member (ceiling wall) 40B includes three slits 40C extending in a fore-and-aft direction, through which the control levers L extend. Further, lateral limit members 40D for the dust-proof member 39 are formed as vertical walls at positions to connect the connecting portions A to the vertical limit member (ceiling wall) 40B.

In order that the vertical limit member 40B holds the three dust-proof members 39 between the bottom surface of the guide member 40 and the top surface of the wall member 35 leaving little space therebetween, with the connecting portions 40S being connected to the top surface of the wall member 35, a distance D defined between the bottom surface of the connecting portion 40A and the bottom surface of the vertical limit member 40B is set to a value corresponding to the thickness of the dust-proof members 39. Further, in order that the three dust-proof members are held between the pair of lateral limit members 40D of the guide member 40 leaving little space therebetween, a distance W defined between the opposing surfaces of the pair of lateral limit members 40D is set to a value that is slightly greater than the total width of the three dust-proof members.

In this manner, the guide member 40 is provided to allow the vertical limit member 40B to limit removal (rising) of the plurality of dust-proof members 39 from the wall member 35, thereby maintaining a condition in which the dust-proof members 39 close the lever-extending through bores S even when the control levers L are operated. In addition, since the outermost dust-proof member 39 in the juxtaposing direction of the dust-proof members is held between the pair of lateral limit members 40D of the guide member 40, the guide member 40 limits displacement of the adjacent dust-proof members 39 in the moving-away direction of the dust-proof members. As a result, even when a force is applied to one of the dust-proof members 39 with an operation of the control lever L in a direction perpendicular to the operating direction of the control lever L (the aforementioned juxtaposing direction), the lateral limit members 40D acting as the vertical walls of the guide member 40 limit displacement of the plurality of dust-proof members 39. Consequently, it is prevented that a large gap is formed between the adjacent dust-proof members, which involves no risk of lowering the dust-proof performance.

More specifically, when a force is applied to one of the dust-proof members 39 with an operation of the control lever L in a direction perpendicular to the operating direction of the control lever L, that dust-proof member 39 is brought into contact with either of the adjacent dust-proof members 39. Then, the adjacent dust-proof member 39 is brought into direct contact with one of the lateral limit members 40D acting as the vertical wall of the guide member 40. This maintains the juxtaposing positional relationships between the plurality of dust-proof members 39 without hindering operation of the dust-proof members 39, and prevents a large gap from being formed between the adjacent dust-proof members.

In this tractor, since the control lever L is pivotable about the axis X, the control lever L, when operated, makes circular movement (pivotal movement) while the dust-proof member 39 makes linear movement in the horizontal direction along the top surface of the wall member 35. Thus, when the control lever L is operated, the control lever L makes circular movement while the dust-proof member 39 makes linear movement, which produces a difference between the moving loci. For such a reason, the control lever L is vertically moved around the slit 39S with operation of the control lever L, which might cause a disadvantage that the inner side of the slit 39S is worn out.

Figure 4:
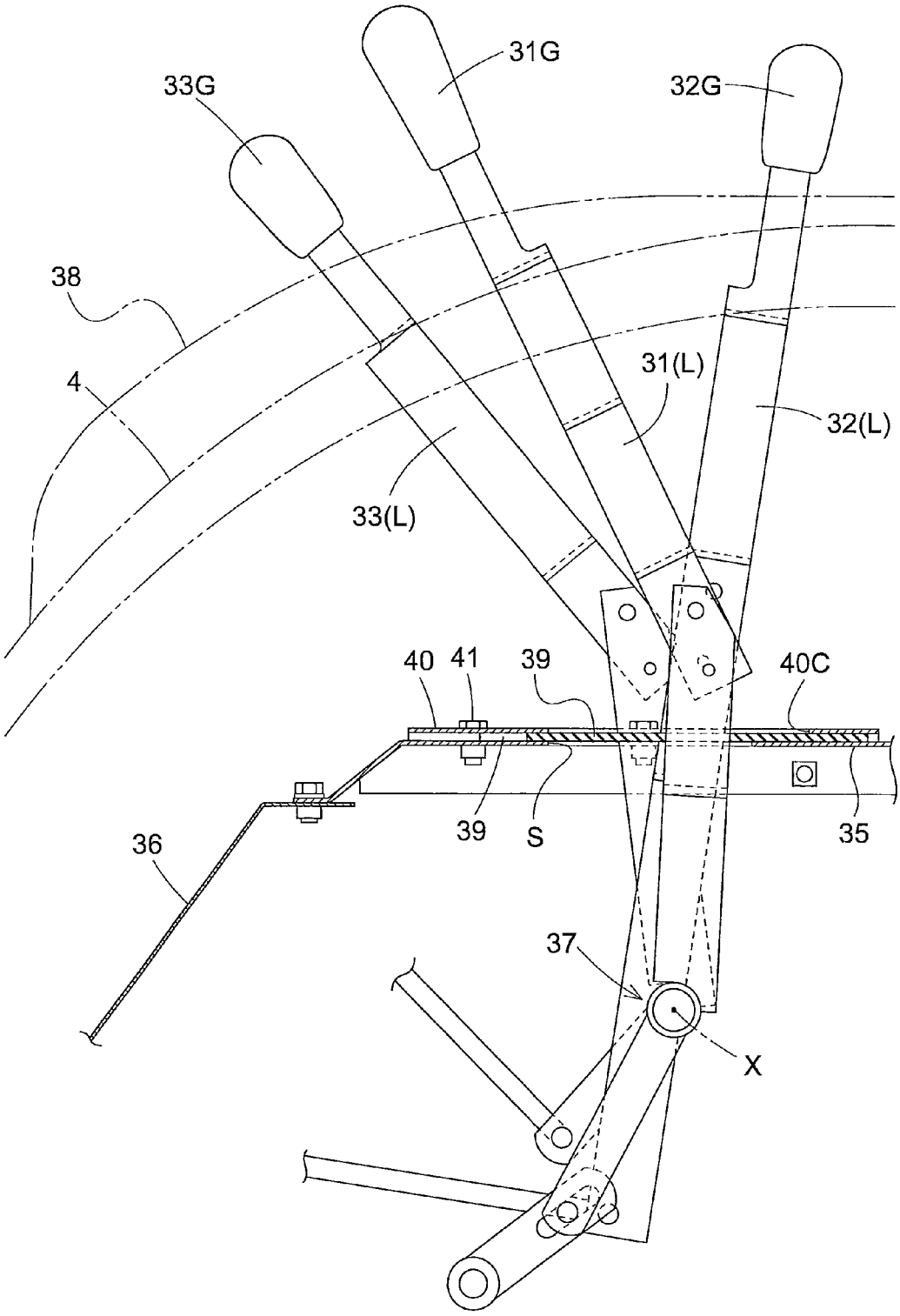
FIG. 4 is a vertical sectional side view illustrating the control levers and a dust-proof arrangement.
Figure 5:
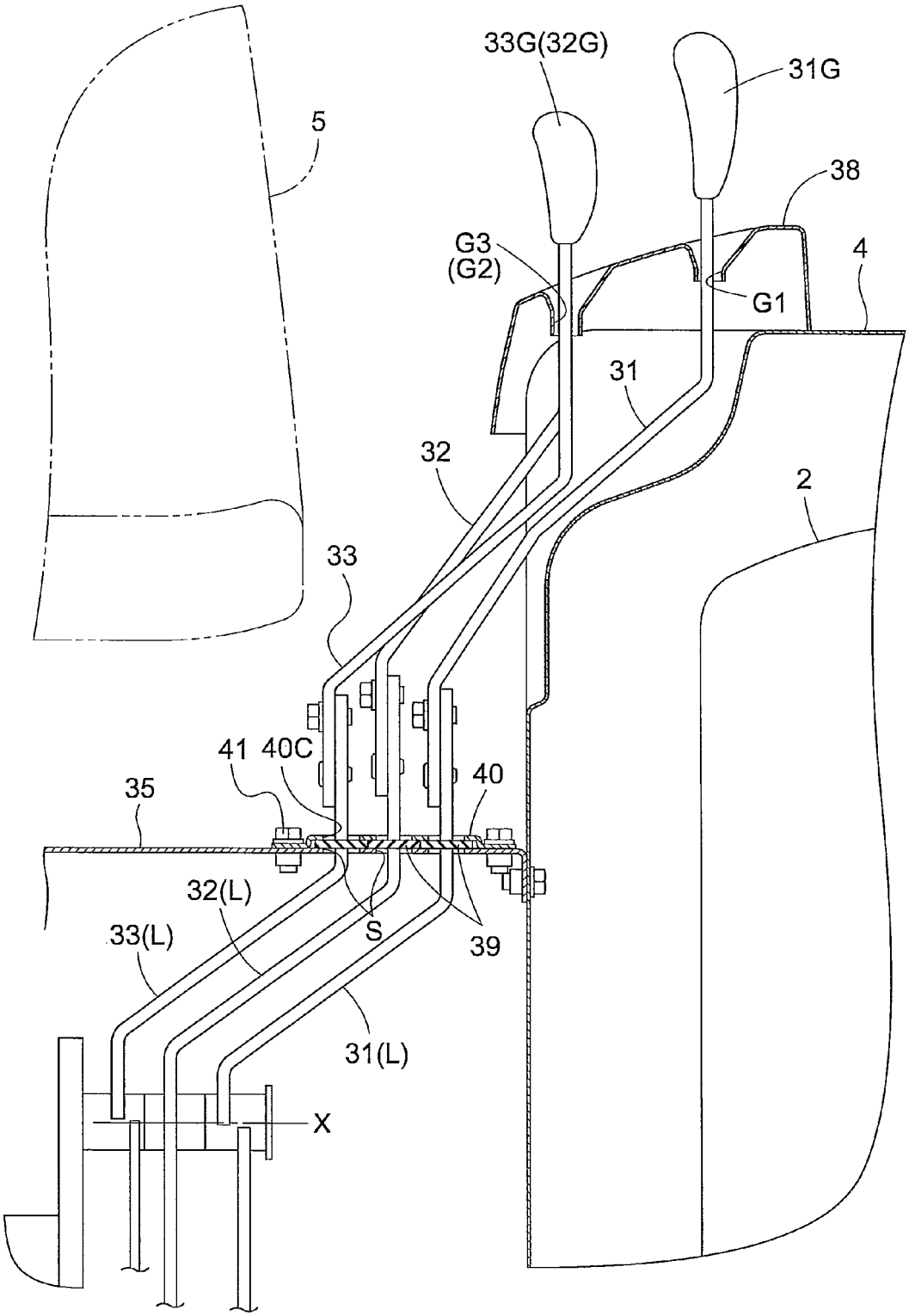
FIG. 5 is a vertical sectional front view illustrating the control levers and the dust-proof arrangement.
Figure 6:
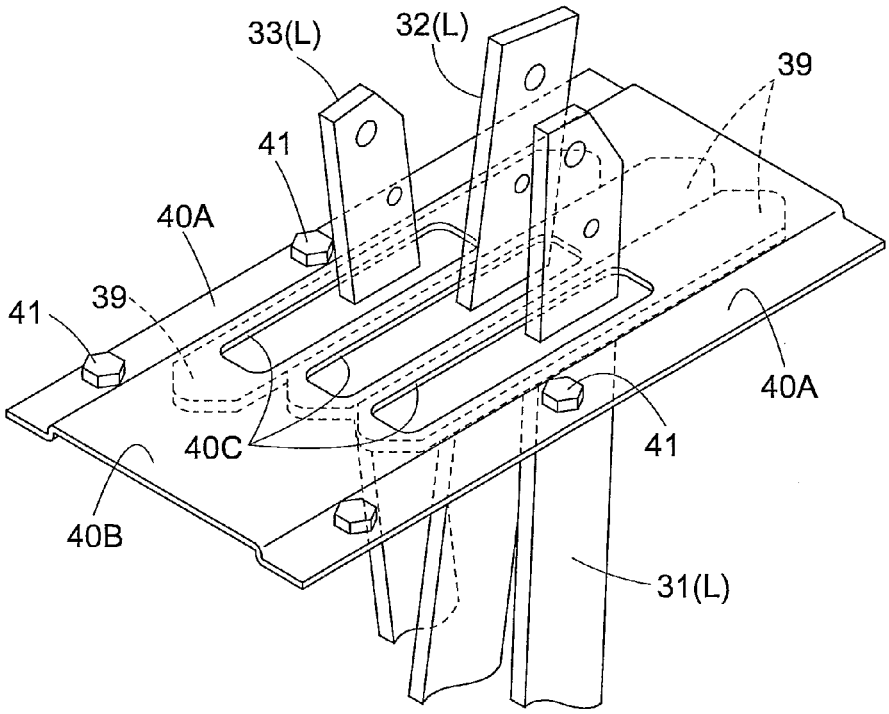
FIG. 6 is a perspective view of the dust-proof arrangement.

In order to deal with such a disadvantage, a relative positional relationship is established such that the control lever L assumes a position to be perpendicular (or approximately perpendicular) to the wall member 35 with the control lever L being set to a neutral position as viewed from the side. FIG. 4 shows that the three control levers L are set to the neutral positions and substantially perpendicular (or perpendicular) to the surfaces of the dust-proof members 39. With this arrangement, an amount of relative vertical movement of the dust-proof member 39 around the slit 39S is small when the control lever L is operated in either direction from the neutral position, which minimizes wear and tear.

Further, according to the control lever device of the present invention, the single guide member 40 acting as the cover is provided to support the plurality of dust-proof members 39, which dispenses with any member for supporting the plurality of dust-proof members separately. As a result, increase in number of parts is suppressed.

Although not shown, the lever apparatus of the present invention is also provided in portions in which the main shift lever 27 and the plowing-depth setting lever 28 extend through the wall member 35.

With such an arrangement, it is prevented that dust and dirt or noise enters the driver's section B due to the dust-proof members 39 for closing the lever-extending through bores S even when dust and dirt or noise reaches around the lever-extending through bores S of the wall member 35 from underneath of the vehicle body. When any of the control levers L is operated, the associated dust-proof member 39 is movable in unison with the control lever L. Even if the dust-proof member 39 makes such movement, it has a dimension enough to close the lever-extending through bore 5, and is limited in rising from the wall member 35 (displacement in the direction to move away from the wall member 35) by the guide member 40. Therefore, the dust-proof member 39 maintains the condition to tight contact with the top surface of the wall member 35 thereby achieving a good dust-proof effect.

Further, increase in number of parts as well as in cost is suppressed by arranging the plurality of dust-proof members 39 to be juxtaposed or parallel with each other and providing the guide member 40 for maintaining such parallel positional relationships. In particular, since the single guide member 40 limits removal (rising) of the plurality of dust-proof members 39 from the wall member 35 and also limits displacement of the plurality of dust-proof members 39 toward the direction to move away from the adjacent dust-proof member 39, the wall member 35 is brought into tight contact with the dust-proof members 39 to avoid the disadvantage that a large gap is defined between the adjacent dust-proof members 39 thereby achieving the excellent dust-proof effect. As a result, the effect of confining conditioned air within the cabin C can be improved to efficiently air-cool or heat the cabin C by the air conditioner 17.

In particular, the control lever L is pivoted by a lesser amount in a position nearer the axis X. Thus, the control lever device is provided around a position of the wall member 35 near the axis X and below the lever guide 38 spaced apart from the wall member 35, thereby to achieve miniaturization of the control lever device compared with the control lever device provided near the lever guide 38, for example.

Modified Embodiments (1) The control lever device of the present invention may have the dust-proof members 39 and the guide member 40 provided in the bottom surface of the wall member 35. In particular, the control lever device may be provided both in the top surface and the bottom surface of the wall member 35. This arrangement achieves the more efficient dust-proof performance.

(2) Instead of the lateral limit members 40D acting as the pair of vertical walls, two pins are provided in one of the lateral sides of the guide member 40 along the dust-proof members 39 while further two pins are provided in the other of the lateral sides of the guide member 40 along the dust-proof members 39. In this case, the two pins provided at one of the lateral sides function as one of the pair of lateral limit members 40D, while the two pins provided at the other of the lateral sides function as the other of the lateral limit members 40D.

The present invention is applicable, other than the tractor, to a vehicle body of a work vehicle including a plurality of control levers juxtaposed with each other, at any portion that needs to prevent entry of dust.

What is claimed is:

1. A control lever device for a work vehicle, the control lever device comprising:

a plurality of control levers to be movable along paths arranged laterally side by side and extending in parallel with each other;

a vertical limit member including lever openings formed therein for the plurality of control levers and extending to allow the movement of the control levers;

a plurality of dust-proof members receiving the respective control levers and movable along the back surface of the vertical limit member following the movement of the control levers to close the lever openings the dust-proof members being arranged side by side in contact with each other in a lateral direction relative to the moving direction of the control levers, the dust-proof members including a first dust-proof member lying on one outermost lateral side and a second dust-proof member lying on the other outermost lateral side;

a pair of lateral limit members for limiting displacement of the dust-proof members in the lateral direction relative to the moving direction of the control levers, one of the lateral limit members being arranged in contact with a lateral outer side of the first dust-proof member, the other of the lateral limit members being arranged in contact with a lateral outer side of the second dust-proof member; and a base having through bores for extending the respective control levers therethrough; a surface of the base including a movable surface for the dust-proof members;

wherein the vertical limit member and the lateral limit members are formed as a single cover to cover the dust-proof members.

2. The control lever device as defined in claim 1, wherein each of the control levers is shaped to have a dimension greater in the moving direction than in the lateral direction of the control levers.

3. The control lever device as defined in claim 1, wherein each of the dust-proof members are made of a flexible material and includes a slit formed therein for receiving each of the control levers.

4. The control lever device as defined in claim 1, further comprising a grip bar attached to a distal end of each control lever, and a lever guide having a guide groove for guiding movement of the grip bar.

5. A work vehicle comprising a control lever device and fenders, the control lever device comprising:

a plurality of control levers to be movable along paths arranged laterally side by side and extending in parallel with each other;

a vertical limit member including lever openings formed therein for the plurality of control levers and extending to allow the movement of the control levers;

a plurality of dust-proof members receiving the respective control levers and movable along the back surface of the vertical limit member following the movement of the control levers to close the lever openings, the dust-proof members being arranged side by side in contact with each other in a lateral direction relative to the moving direction of the control levers, the dust-proof members including a first dust-proof member lying on one outermost lateral side and a second dust-proof member lying on the other outermost lateral side;

a pair of lateral limit members for limiting displacement of the dust-proof members in the lateral direction relative to the moving direction of the control levers, one of the lateral limit members being arranged in contact with a lateral outer side of the first dust-proof member, the other of the lateral limit members being arranged in contact with a lateral outer side of the second dust-proof member; and a base having through bores for extending the respective control levers therethrough, a surface of the base including a movable surface for the dust-proof members;

wherein the vertical limit member and the lateral limit member are formed as a single cover to cover the dust-proof member, and wherein the lever guide is provided in one of the fenders.

6. The work vehicle as defined in claim 1, wherein the control levers are disposed between a driver's seat and the fenders.

* * * * *

UNITED STATES PATENT AND TRADEMARK OFFICE

CERTIFICATE OF CORRECTION

PATENT NO. : 8,739,650 B2
APPLICATION NO. : 13/038917
DATED : June 3, 2014
INVENTOR(S) : Koji Masumoto It is certified that error appears in the above-identified patent and that said Letters Patent is hereby corrected as shown below:

In the Claims:

Column 7, Line 47, Claim 1, after “openings” insert -- , --

Column 7, Line 54, Claim 1, after “members” delete “for”

Column 8, Line 5, Claim 1, delete “therethrough;” and insert -- therethrough, --

Column 8, Line 40, Claim 5, after “member” delete “for”

Signed and Sealed this
Ninth Day of September, 2014

Michelle K. Lee

Michelle K. Lee
*Deputy Director of the United States Patent and Trademark Office*